US005940995A

United States Patent [19]

Venhomaa

[11] Patent Number: 5,940,995

[45] Date of Patent: Aug. 24, 1999

[54] APPARATUS FOR FORMING A SNOW HALF-PIPE

[76] Inventor: Martti Venhomaa, Linnunpääntie 6 G 79, FIN-20810, Turku, Finland

[21] Appl. No.: 08/913,511

[22] PCT Filed: Jul. 1, 1996

[86] PCT No.: PCT/FI96/00386

§ 371 Date: Sep. 16, 1997

§ 102(e) Date: Sep. 16, 1997

[87] PCT Pub. No.: WO97/29243

PCT Pub. Date: Aug. 14, 1997

[30] Foreign Application Priority Data

Feb. 9, 1996 [FI] Finland ..... 960089 U

[51] Int. Cl.[6] ..... E01H 5/09

[52] U.S. Cl. ..... 37/240; 37/219; 37/464; 37/465

[58] Field of Search ..... 37/219, 237, 242, 37/243, 240, 244, 305, 352, 364, 365, 91, 94, 338, 462, 464, 465, 463; 172/245, 247, 684.5

[56] References Cited

U.S. PATENT DOCUMENTS

| | | | |
|---|---|---|---|
| 1,235,456 | 7/1917 | Fossum | 37/388 |
| 1,535,699 | 4/1925 | Talbot | 37/237 X |
| 1,727,186 | 9/1929 | Webster | 37/237 |
| 1,816,389 | 7/1931 | Moberg | 37/237 X |
| 1,882,382 | 10/1932 | Gerlach | 37/237 |
| 2,402,976 | 7/1946 | Olson | 37/388 |
| 3,539,014 | 11/1970 | Jonsson | 37/219 X |
| 3,744,568 | 7/1973 | Beyers et al. | 37/388 X |
| 3,777,822 | 12/1973 | Stedman et al. | 37/237 X |

*Primary Examiner*—Victor Batson

*Attorney, Agent, or Firm*—Pollock, Vande Sande & Amernick

[57] ABSTRACT

A shaping apparatus for the working/maintenance of a snow-boarding half-pipe. The apparatus comprises a framework with a curved portion serving to support and guide a pair of drive chains actuated to run over an endless path. To the drive chains are attached scraper elements adapted to extend perpendicularly outward from the endless path of the chains, the scraper elements being designed to cut away snow from the half-pipe surface to be shaped. The scraper elements further incorporate elements serving to move the detached snow along the shaped surface and to smooth the surface. The apparatus is intended for attaching to a self-actuated vehicle, to be powered therefrom.

4 Claims, 3 Drawing Sheets

APPARATUS FOR FORMING A SNOW HALF-PIPE

The present invention relates to an apparatus for shaping a snow course, particularly so-called half-pipe used in snow-boarding on the faces of a piste.

This task is conventionally accomplished by means of movable equipment intended for working and servicing skiing pistes, typically a snow course maintenance tractor which is a self-actuated vehicle moving on wide tracks. Such a vehicle is provided with a power outtake, and standardized implement links can be attached to it for operating different accessories and implements. For shaping a snow course, to the links is conventionally attached a shovelling scraper which is contoured to shape the snow course to a desired cross section. Snow-boarding is conventionally carried out in a half-pipe having its walls circularly shaped with a radius of curvature of approx. 3–4.5 m. The width of the flat bottom area between the curved walls may vary in the range 5–20 m.

Drawbacks of equipment with a conventional construction include problems related to the heavy weight of the equipment resulting from the forward cutting operating principle which requires an enormous pushing capacity from the equipment. Hence, the equipment must be dimensioned to cope with the stresses imposed on the parts of the machine. Moreover, shaping of a half-pipe using such equipment is cumbersome as the snow course inclination varies according to the moguls of the course terrain. A further problem in the maintenance of a half-pipe using conventional embodiments arises from the need of snow replenishment. When the walls of the half-pipe become worn with grooves through use, conventional equipment can remove such grooves only by cutting away snow from the walls of the half-pipe down to the bottom of the groove. While this may be possible with a sufficiently thick snow wall, in many cases snow replenishment to the walls is necessary to achieve a satisfactory result.

An essential improvement over the above-mentioned draw-backs hampering the construction and function of prior-art equipment is achieved by means of the apparatus according to the present invention, the essential characterizing properties of the apparatus being disclosed in the annexed claim 1. Additional characteristics of the invention are defined in the dependent claims.

Figure 1:
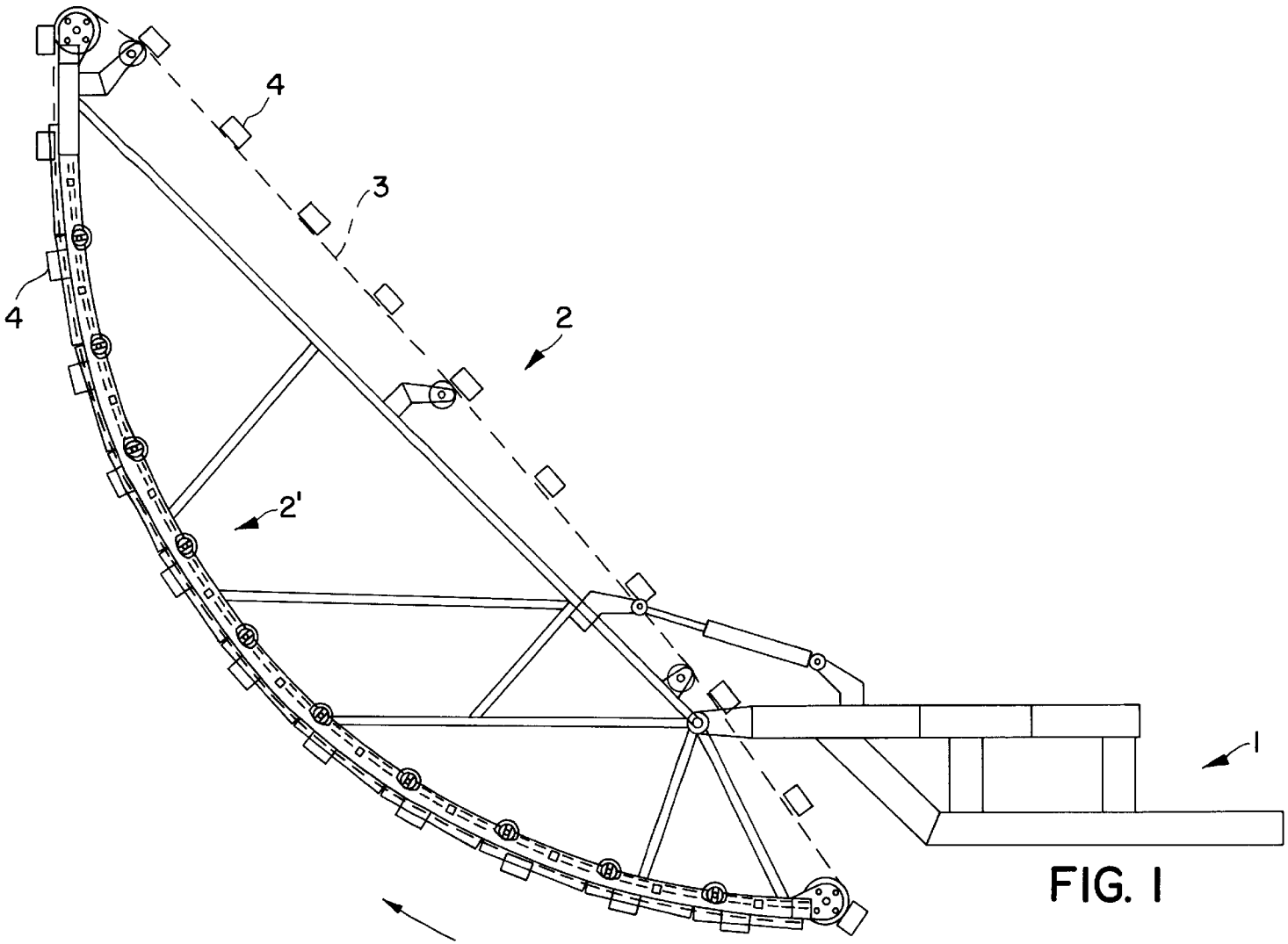
Figure 2:
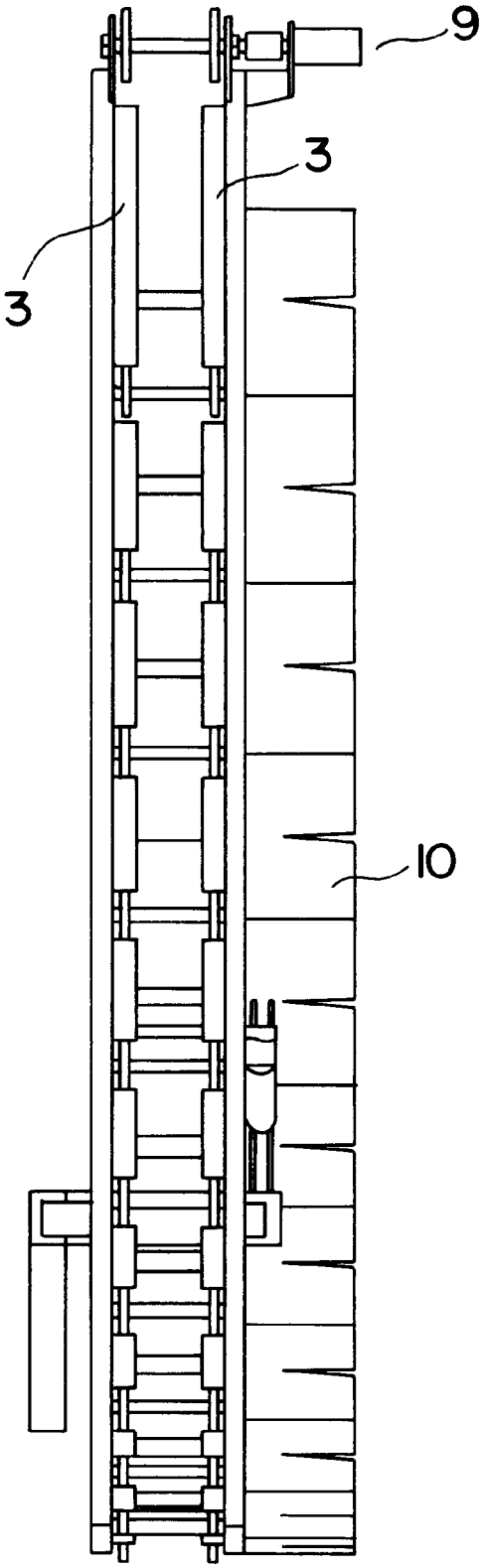

In the following, the invention will be explained in greater detail by making reference to the appended drawings in which FIG. 1 is a view of an apparatus according to the invention as seen in its intended working direction;

FIG. 2 is a top view of the working section of the apparatus; and

Figure 3:
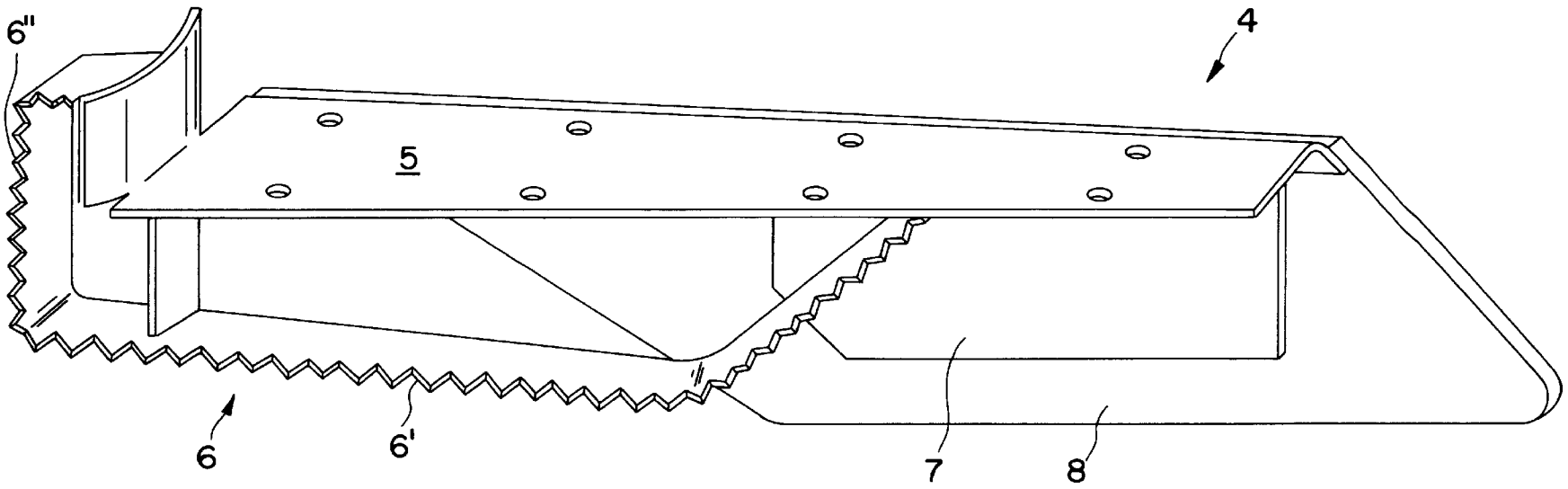

FIG. 3 a perspective view of the scraping element of the apparatus.

Referring to the drawings, the apparatus according to the invention is constructed supported by a lattice framework 2 and is designed mountable its attachments 1 to an appropriately moving self-actuated vehicle. Advantageously, such a self-actuated vehicle is the above-mentioned maintenance machine of skiing courses.

Over the working section of the apparatus, said framework 2 is designed into a curved guidance path 2' incorporating suitable supports and guides for the power-actuated movement of a flexible drive means such as two parallel running chains 3. The guides may comprise guide rolls and slide surfaces in a conventional manner. The parallel chains 3 are formed into an closed loop driven by a drive unit actuated by a hydraulic motor 9.

To the parallel chains 3 are attached a plurality of scraper members 4 which project outward from said chain and arranged into a row along the movement direction of the chains. The scraper members 4 form the actual tool elements of the apparatus, and their structure and function will be explained in greater detail later in the text.

The framework 2 is advantageously connected to the support links 1 so that the apparatus can be turned in the vertical plane to different angles of inclination. Furthermore, the apparatus may be equipped with arrangements facilitating swinging of the apparatus from one side of the self-actuated vehicle to the other side for the purpose of shaping both walls of the half-pipe during a unidirectional run of the vehicle, e.g., downhill the course. In a similar manner, the apparatus may advantageously be turned to different angles with respect to the propagation direction of the vehicle, either reaching slightly forward, or alternatively, to a backward lagging angle. Obviously, the apparatus may be attached in an equivalent manner to the rear of the vehicle, whereby the vehicle may even have one apparatus working one wall in front of the vehicle, while a second apparatus is mounted to the rear of the vehicle for working the other wall of the half-pipe.

Referring to FIG. 3, the scraper element 4 designed for use in the apparatus is here shown in greater detail. In the illustrated embodiment, the scraper element is provided with a base plate 5 equipped with suitable attachments for fastening onto said drive chains 3. The base plate is aligned crosswise with respect to the movement direction of the chains. To the base plate is attached a cutting blade 6 spaced at a distance from the base plate 5 in a perpendicularly outward direction from the loop of the drive chain so that a gap will remain between the blade 6 and the base plate 5. Additionally, the scraper element includes a shove plate 7 located at the rear of the scraper element relative to the working direction of the element. The primary function of the plate 7 is to push snow cut away by the blade 6 upward along the curved wall of half-pipe and further over the edge of the half-pipe, where it remains available for subsequent maintenance sessions. The shove plate 7 is still followed by a smoothing element 8 adapted to sweep over the worked snow surface, thus serving to fill depressions on the surface of the half-pipe with snow detached by the blade so finishing the smoothing effect accomplished by the plate 7.

In the illustrated embodiment, the scraper element 4 includes a two-part blade 6. The first part thereof, the bottom part 6' is aligned parallel with the base plate 5 thus serving to work the surface of the curved wall being shaped by way of cutting along said surface. To one end of this bottom part 6' of the cutting blade is angled perpendicularly a second cutting blade part 6", later called the tip blade. This tip blade is aligned in the working direction of the apparatus, and its function is to perform vertical cutting-away along the edge of the slice to be removed from the snow wall.

A scraper element thus shaped is obviously suitable for a unidirectionally moving apparatus only. To permit bidirectional operation of the apparatus, the scraper element design must be modified accordingly by, e.g., angling a tip blade 6' to both ends of the cutting blade 6'. Similarly, an appropriate design of the shove plate 7 is required to smoothing in both directions with the use of a bidirectionally operating shaping apparatus.

For further finishing of the smoothing result, the apparatus may further include sweeping apron plates made from a resilient sheet material that are attached to the rear edge of the curved part of the framework 2.

I claim:

1. An apparatus for shaping a snow course, comprising a tool member shaped compliant with a desired contour of a wall of a snow-boarding half-pipe and attached by implement links to a self-actuated vehicle, and wherein the tool member is aligned essentially perpendicular to a movement direction of said vehicle and includes a flexible drive element adapted to run over an endless path essentially circular over a working section of the apparatus, the path being governed by a guidance structure in an essentially vertical plane, and at least one scraper element extending perpendicularly outward from a loop of said drive element, wherein said scraper element comprises a base structure serving to attach said scraper element to said drive element, a cutting blade attached to said base structure, said blade being formed into a planar bottom blade attached at a distance from and essentially parallel to said base structure and into a tip blade adapted to at least one end of and angled essentially perpendicularly to said bottom blade, and a shovel plate located at a rear of the scraper element relative to a working direction of said element.

2. An apparatus as defined in claim 1 which further comprises a power transmission element formed by two parallel running chains.

3. A scraper element as defined in claim 1, which further incorporates a smoothing element adapted at a rear of said cutting blade relative to its cutting direction.

4. A scraper element as defined in claim 2, which further incorporates a smoothing element adapted at a rear of said cutting blade relative to its cutting direction.

* * * * *